United States Patent [19]

Slade, Jr. et al.

[11] Patent Number: 4,709,922

[45] Date of Patent: Dec. 1, 1987

[54] BARBELL SUPPORT APPARATUS FOR WEIGHT LIFTING EXERCISING

[76] Inventors: James R. Slade, Jr., 45 Cedar Hill Rd., Randallstown, Md. 21133; Richard F. Sterba, 9536 Bauer Ave., Baltimore, Md. 21236

[21] Appl. No.: 821,162

[22] Filed: Jan. 21, 1986

[51] Int. Cl.[4] ..... A63B 13/00

[52] U.S. Cl. ..... 272/123; 272/117

[58] Field of Search ..... 272/117, 123, DIG. 4, 272/93, 116, 118, 134, 143, 126; 248/317, 328, 320

[56] References Cited

U.S. PATENT DOCUMENTS

| | | | |
|---|---|---|---|
| 455,547 | 7/1891 | Morgan | 248/320 |
| 1,633,344 | 6/1927 | Moran | 248/328 |
| 3,979,114 | 9/1976 | Codina | 272/126 |
| 3,982,756 | 9/1976 | Hersey et al. | 272/126 X |
| 4,060,240 | 11/1977 | Dunston | 272/126 |
| 4,084,815 | 4/1978 | Flannery | 272/117 X |
| 4,216,959 | 8/1980 | Niles | 272/123 |
| 4,249,726 | 2/1981 | Faust | 272/123 |
| 4,253,662 | 3/1981 | Podolak | 272/123 |
| 4,324,398 | 4/1982 | Hole | 272/123 |
| 4,471,956 | 9/1984 | Marlo | 272/123 |

FOREIGN PATENT DOCUMENTS

| | | | |
|---|---|---|---|
| 1061375 | 8/1979 | Canada | 272/93 |
| 707337 | 7/1931 | France | 248/328 |

*Primary Examiner*—Richard J. Apley
*Assistant Examiner*—Robert W. Bahr
*Attorney, Agent, or Firm*—John F. McClellan, Sr.

[57] ABSTRACT

A barbell support apparatus for weight lifting exercising which has an overhead pulley that supports and guides a single support cable. The support cable is attached at both ends to a barbell. The pulley is suspended from a suspension system that provides for height adjustment of the barbell. Cable stops are adjustably fixed on the support cable on both sides of the pulley to limit linear travel of the support cable across the pulley. A clamping cable collar that can be attached directly to a support line (or cable) is also disclosed.

4 Claims, 4 Drawing Figures

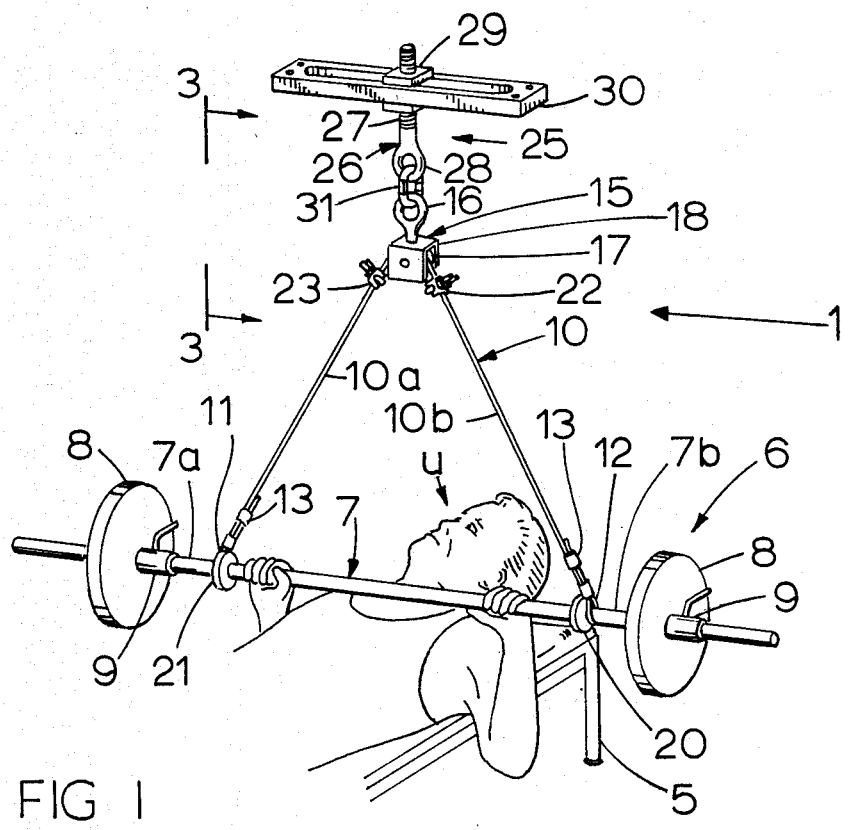
FIG 1
FIG 3
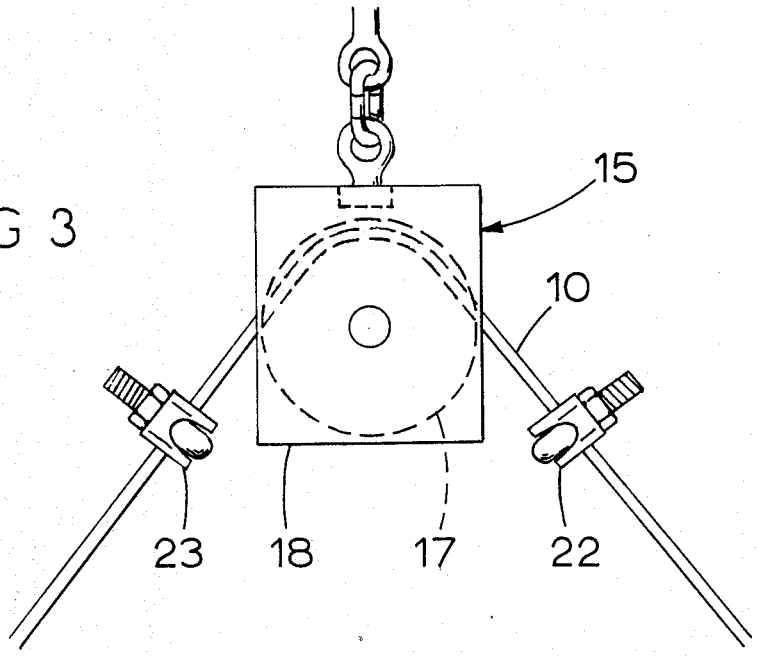

BARBELL SUPPORT APPARATUS FOR WEIGHT LIFTING EXERCISING

FIELD OF THE INVENTION

This invention relates generally to exercise equipment and specifically to a barbell support apparatus for weight lifting exercising.

BACKGROUND OF THE INVENTION

Many barbell support apparatuses that protect a weight lifting exerciser from injury while performing such weight lifting exercises as the bench press and the barbell squat are known. Examples include those disclosed in the following U.S. Patents:

U.S. Pat. No. 4,216,959 to A. Niles, 8-12-80, disclosed a safety chain system having two separate chain devices which suspend at a pre-selected height the two ends of a weight lifting barbell;

U.S. Pat. No. 4,249,726 to R. Faust, 2-10-81, disclosed a rack structure designed with safety arms that may be hydraulically or electrically activated by the exerciser to raise a weight lifting barbell from his chest while performing the bench press exercise;

U.S. Pat. No. 4,253,662 to W. Podolak, 3-3-81, disclosed an overhead hoist-type mechanism having a motor driven clutch design that is user-activated to lift a weight lifting barbell from a user's chest while bench pressing, including a triangulated, non-passive-type, single cable suspension system that has a static support ring (the support ring 60 represents the central overhead support point for the triangulated design);

U.S. Pat. No. 4,324,398 to R. Hole, 4-13-82, disclosed a steel frame structure with pulley guided safety cables that extend from an adjustable safety locking bar to the weight lifting barbell; and, U.S. Pat. No. 4,471,956 to S. Marlo, 9-18-84, disclosed a weight lifting aid for bench press exercising that has a foot-activated, counterbalancing weight system which includes a triangulated, multi-cable suspension design with a static support ring (the support ring 15 represents the central overhead support point).

However, none of the above or any barbell support apparatus forweight lifting exercising known to present is believed to offer the advantages of this invention.

SUMMARY OF THE INVENTION

A principal object of this invention is to provide a non-user-activated or passive-type barbell support apparatus for weight lifting exercising that incorporates a pulley-guided support cable or elongate member that is attached at spaced locations towards the ends of a weight lifting barbell.

A further object is to provide a support cable having two cable stops which limit the range of movement, through the support pulley, of the support cable, in either direction, thereby preventing the suspended weight lifting barbell from tilting excessively, away from the horizontal starting position for the bench press or squat repetition.

And a still further object is to provide an adjustable height, passive-type barbell support apparatus that can be suspended from an convenient overhead structure that will support the projected barbell weight load.

BRIEF DESCRIPTION OF THE DRAWINGS

The above and other objects and advantages of this invention will become more readily apparent on examination of the following description, including the drawings in which like reference numerals refer to like parts.

FIG. 1 is a perspective view of a preferred embodiment of the invention in a mode of use;

FIG. 3 is a frontal detail taken at 3—3, FIG. 1 of the suspended support pulley, support cable and cable stops; and, FIG. 4 is a perspective fragmentary detail view of a clamping cable collar, in position on the weight lifting bar.

DETAILED DESCRIPTION

Figure 2:
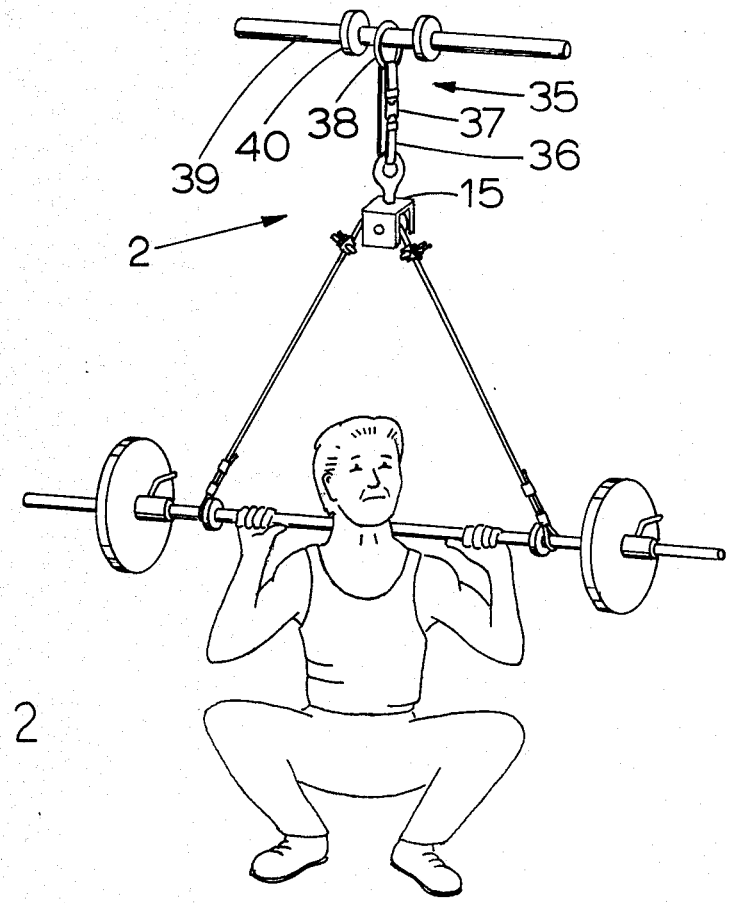
FIG. 2 is a perspective view of a second embodiment of the invention showing another mode of use.

FIG. 1 shows the invention in embodiment 1. In this figure, the invention is being used by the user U while performing the bench press exercise. The user U is shown lying in a supine position, on bench press bench 5, bench pressing the barbell 6 which is an assembly of weight plates 8 and weight plate collars 9 on a weight lifting bar 7.

The barbell support apparatus for weight lifting exercising, illustrated in embodiment 1, includes:

(a) a single length of steel wire rope support cable 10, for example conventionally available aircraft wire cable, load rated to support the projected barbell weight loads;

(b) a support pulley 15 which supports and guides the support cable 10;

(c) two cable blocking collars 20, 21 which are securely affixed to the weight lifting bar 7 by conventional means to be described;

(d) two safety cable stops 22, 23 which are adjustably fixed on the support cable 10, with one cable stop being on each side of the support pulley 15; and, (e) a suspension system 25 which suspends the support pulley 15, support cable 10, and barbell 6 above the user U.

The barbell support apparatus for weight lifting exercising, illustrated in embodiment 1, is secured to the weight lifting bar 7 as follows:

(1) The cable blocking collars 20, 21 are affixed to the weight lifting bar. The cable blocking collars may be, as an example, conventionally available one-piece, compression-type shaft clamping collars. The first blocking collar 20 is positioned toward a first end *7b* of the weight lifting bar while the second blocking collar 21 is positioned toward a second end *7a* of the weight lifting bar. Generally, the user U adjustably positions the blocking collars 20, 21 far enough apart so that he can comfortably grip the weight lifting bar for each weight lifting exercise (note: it would be possible to weld the cable blocking collars to the weight lifting bar if the user used the same blocking collar position on the weight lifting bar for each exercise). Additionally, each blocking collar is generally positioned equidistant from the midpoint of the weight lifting bar so that the center of gravity of the weight lifting bar remains at the midpoint along the linear length of the weight lifting bar.

(2) The first and second ends *7b* and *7a* of the weight lifting bar 7 are inserted through the respective loops 12 and 11 that are formed at the two ends of the support cable 10. The loops 11, 12 are made in the support cable using, as an example, conventionally available cable swage sleeves 13. The loops 11, 12 are pushed inward along the length of the weight lifting bar until they contact respective blocking collars 21 and 20. It should be noted that the loops 11, 12 have a snug friction fit on the weight lifting bar 7. The friction fit for the loops 11, 12 keeps the ends of the support cable 10 with cable swage sleeves 13 from rotating below the weight lifting bar when the barbell 6 is pushed upward by the user U.

ASSEMBLY

After the support cable 10 is attached to the weight lifting bar 7, the support pulley 15 is connected to the suspension system 25 which has been securely fixed to a convenient, high-strength overhead structure (not shown) such as the ceiling rafters or steel ceiling support beams in a user's home, or the lat machine apparatus of many standard weight lifting exercise machines. With the support pulley 15 attached to the suspension system 25, the weight lifting bar 7 will be hanging directly below the support pulley 15, and the support cable 10 will have no slack in either of the support cable legs 10*a* or 10*b*. At this point, the user adjusts the suspension system 25 until the weight lifting bar 7 is suspended at a pre-selected distance above the location of his chest when he is lying in a supine position on the bench press bench (note: the long axis of the weight lifting bar is in a horizontal plane). This final height adjustment for the weight lifting bar pre-sets the lowest horizontal level that the weight lifting bar can descend to when it is suspended in a horizontal plane. The user can then load the weight plate collars 9 and the weight plates 8 onto the weight lifting bar.

The suspension system 25 that is shown in this figure is one of many types that may be used. It includes a high-strength I-bolt 26 that has a threaded shank 27 and an I-portion 28. The threaded shank 27 may be screwed upward or downward through the adjustment/locking nuts 29 which attach and adjust the I-bolt to the overhead bar 30. Support pulley 15, which may have, as an example, a standard swivel-type eye 16, is attached to the I-portion 28 of the I-bolt 26 by a conventionally available high-strength connecting link 31.

In this figure, the overhead bar 30 is, as an example, a grooved, heavy steel bar which may be securely bolted, as an example, to a rigid overhead support structure (not shown) such as the rafters or the steel ceiling beams in a user's home. It should also be obvious that this groove steel bar is analogous to the grooved design of the lat machien pulley structure (not shown) of many types of standard weight lifting machines. Consequently, the present barbell support apparatus for weight lifting exercising could be just as easily attached to these lat machine structures, provided of course that the lat machine structures are rated to support the weight loads that the user may use for any particular exercise.

The present invention is similar to some prior-art, passive-type barbell support apparatuses because it also functions to support the barbell above the user at a pre-selected height prior to his initiating a specific weight lifting exercise (as an example, see U.S. Pat. No. 4,216,959 as mentioned above). Because of this passive-support design, the user is not required to manually activate the barbell support system during the exercise should he be unable to physically lift or control the barbell.

Additionally, the present invention has a triangulated-design appearance similar to that of a number of prior-art apparatuses (as an example, see U.S. Pat. No. 4,471,956 as mentioned above). These apparatuses utilize two support structures (representing two sides of the triangulated design) that extend downward from an attachment at a central overhead support point to a barbell (see U.S. Pat. No. 4,471,956, FIG. 1, nos. 1*a*, 1*b*, 15, 10). The support structures, which are generally steel wire rope cable or steel chain, are secured at two different locations on the barbell (the distance between the attachment locations on the barbell for the two support structures represents the third side of the triangulated design).

The uniqueness of the present invention, however, stems from the fact that the central overhead support point, that was mentioned above, has been replaced by the support pulley 15 which is a mechanical, anti-friction device that is capable of imparting movement to a single, continuous support cable 10. By utilizing a system that has a single support cable 10 with cable stops 22, 23 that freely travels or passes over and across the rotatable pulley 17 of support pulley 15, within the limiting range of travel set by the cable stops, the following performance benefits are built into the present barbell support apparatus for weight lifting exercising.

One benefit of the present barbell support apparatus is that it eliminates the uncomfortable jerkiness in weight lifting movement that is associated with those prior-art, passive-type barbell support apparatuses that utilize two support structures, such structures generally of either steel chain or steel wire cable, that extend downward from either an affixation at a central overhead support ring (see U.S. Pat. No. 4,471,956 as mentioned above) or affixations from separate overhead support rings (see U.S. Pat. No. 4,216,959 as mentioned above) to a barbell, for attachment at different locations on the weight lifting bar.

A second benefit from utilizing the support pulley/-single support cable/cable stops design is that the support cable 10 may be protected from premature breakage by selecting a pulley 17 with sufficient diameter, as determined by standard engineering practice, so as to prevent any accelerated fatiguing of the individual steel wire fibers (not shown) that make up the support cable.

The Essence of the Invention

The third benefit from utilizing the support pulley/-single support cable/cable stops design is that in those situations where the barbell is lowered—on the downstroke of the bench press repetition—to the suspended position (rest position) with the weight lifting bar 7 at an inclined angle relative to the user's chest (assume that the user's chest represents a horizontal plane), the user can immediately reposition the weight lifting bar 7 in parallel alignment with his chest by simply rotating the suspended barbell 6 back to the starting horizontal position. Rotation of the inclined barbell 6 is easily accomplished with the present barbell support apparatus because the user needs only to push up on the low end of the barbell and pull down on the high end of the barbell, thereby causing the taut support cable to travel smoothly across the rotating pulley. The present invention provides a functional mechanical advantage over the prior-art (see U.S. Pat. No. 4,253,662, FIG. 3 as mentioned above) because the inhibiting frictional forces of the support ring/single support cable design of the prior-art apparatus have been virtually eliminated with the support pulley/single support cable/cable stops design of the present invention. Because the present barbell support apparatus enables the user to quickly and easily rotate the inclined (suspended) barbell back to the starting horizontal position, the user is able to begin each bench press repetition with both of his arms comfortably positioned for movement through the same range of motion, thereby promoting balanced bilateral strength training for his arms during the upstroke of the bench press repetition.

The fourth benefit from utilizing the support pulley/-single support cable/cable stops design is that the user is protected from injury by an internal safety mechanism, namely, the two cable stops 22, 23 interacting with the support pulley 15 to limit the rotation of the suspended barbell 6. Without the cable stops, the support pulley and single support cable could not function as a passive-type barbell support apparatus because an unrestricted range of rotation for the barbell, within the limits set by the entire support cable length, creates a situation in which the user could be pinned under and possibly crushed by an uncontrolled, rotating barbell (such a situation would exist if a user lost consciousness while weight lifting). However, by adjustably fixing the two cables stops 23, 22 on the respective support cables legs 10*a*, 10*b*, a true passive-type barbell support apparatus is created.

Functionally, the cable stops 22, 23 contact the pulley housing 18 from their respective side f the support pulley as the support cable 10 travels across the pulley 17, thereby limiting the number of degrees of lengthwise, vertical rotation for the weight lifting bar 7. The general rule for positioning the cable stops, which may be adjustable-type cable or line clamps (including, as an example, standard wire rope clips), on the support cable 10 in spaced relationship with the support pulley 15 is as follows: Depending on the distance that the weight lifting bar 7 is initially suspended above the user's chest (assume that the weight lifting bar is suspended horizontally), the cable stops can be adjustably fixed on respective support cable legs 10*a* and 10*b* at an equal distance from the support pulley, with the distance between each cable stop and the support pulley being adjusted to insure that the maximum angle of incline for the weight lifting bar (in the suspended position), away from the original horizontal position in either direction of rotation, will still not allow the weight lifting bar to contact the user's chest. As a result, the rotation of the suspended barbell is restricted by the present barbell support apparatus to a very narrow angular range, a range in which controlled movements of the barbell—namely, actual bench press repetitions by the user—are not restricted by the mechanical functioning of the present barbell support apparatus, but a range in which uncontrolled movements of the barbell—namely, excessive vertical barbell rotation that could possibly cause injury to the user—are mechanically blocked.

The fifth benefit from utilizing the support pulley/-single support cable/cable stops design is that the cable stops 22, 23 may function as a training aid for the user, because he can use the cable stops as overhead observational markers that help him to maintain the generally preferred parallel spatial relationship between the weight lifting bar of the barbell and the surface of the user's chest, during the bench press movement. Because the cable stops can be symmetrically fixed to the support cable on either side of the support pulley 15 when the barbell is horizontally suspended in the starting position, the user knows that when he lowers the barbell to a resting position on the downstroke of a bench press repetition, the weight lifting bar will once again be horizontally suspended over his chest if the cable stops are also symmetrically positioned on both sides of the support pulley. Consequently, by observing either the symmetry or the non-symmetry of the spatial relationship of the cable stops to the support pulley, the user will recognize immediately whether or not he is lowering the weight lifting bar in parallel relationship to his chest. The reason for using this observational training technique is that it helps the user to train himself to exercise both of his arms through the same range of motion on the downstroke of the bench press repetition, thereby promoting balanced bilateral strength training.

FIG. 2 shows a second embodiment 2 of the invention, with the invention being used for the barbell squat exercise. In this figure, the embodiment 2 of the invention is nearly identical to embodiment 1, FIG. 1, the only difference being that an alternative suspension system 35 is used. The suspension system 35 shown in FIG. 2 includes an adjustable length, high-strength woven fabric strap 36 (with ratcheting buckle 37) that attaches the support pulley 15 to the steel suspension ring 38. The suspension ring 38 is suspended from the steel rod 39, and the suspension ring can be positioned on steel rod 39 between standard shaft collars 40 which may be adjustably attached to the steel rod 39. The steel rod 39 can be rigidly affixed to a convenient, high-load capacity overhead structure such as the ceiling rafters (not shown) in a user's home.

It should be clearly understood that the suspension system that is used to suspend the support pulley, support cable, and barbell can be made from many alternative combinations of overhead suspension materials such as steel chain, steel wire rope cable, andhigh-strength woven fabric strapping, together with many types of height adjusters such as I-bolts, chain grab hooks, and fabric strap adjusters.

FIG. 3 is a frontal detail taken at 3—3, FIG. 1 of the support pulley 15, support cable 10, and safety cable stops 22, 23. This figure shows the support cable 10 being guided and supported by the pulley 17 that is contained within the pulley housing 18 of the support pulley 15. Support cable 10 travels across pulley 17 in either direction (either left or right as viewed in this figure), and the cable stops 22, 23 may contact the pulley housing 18 from respective sides of the support pulley, thereby limiting the linear distance that the support cable 10 can travel across the pulley 17. Additionally, this figure shows that the width of pulley housing 18 is greater than the diameter of pulley 17. By having an oversized housing, the cable stops 22, 23 are prevented from making direct contact with the cable groove (not shown) in pulley 17. As a result, the pulley cannot be damaged by the cable stops.

Figure 4:
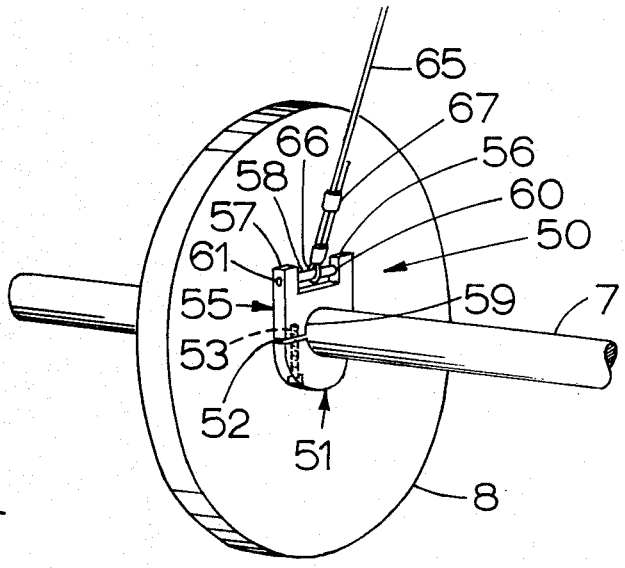

FIG. 4 is a perspective view of a clamping cable collar 50. Clamping cable collar 50 is a simple two-section collar having:

(a) a lower section 51 that has a weight lifting bar hole 59 through which is inserted the weight lifting bar 7. The lower section also has a horizontal split at location 52. The horizontal split projects inward through the boundary surface of the weight lifting bar hole. A clamping screw 53 is internally threaded, in a vertical direction, into the side of the lower section that has the horizontal split, and the clamping screw passes through the horizontal split. When the clamping screw is screwed into the lower section, the upper and lower boundary surfaces of the horizontal split are drawn closer together, causing the boundary surface of the weight lifting bar hole to be compressed on the weight lifting bar, with the result being that the weight lifting bar 7 is frictionally clamped within the weight lifting bar hole 59.

(b) an upper section 55 that includes two vertically projecting tips 56 and 57, and connecting them a horizontal connector bolt 58. The connector bolt may be, as an example, a high-strength shoulder bolt that passes through a bolt hole 60 in the first projecting tip 56 and which is then screwed into the threaded hole 61 in the second projecting tip 57.

The support line 65, which may be, as an example, conventionally available aircraft wire rope cable, is attached to the connector bolt 58 by loop 66 in the end of the support line. The loop may be formed by using, as an example, conventionally available cable swage sleeves 67. The loop 66 has a snug friction fit on the connector bolt 58.

Finally, this figure shows the clamping cable collar 50 being used as a weight plate collar, in place of the standard weight plate collar 9 as seen in FIGS. 1 and 2. The weight plate 8 has been pushed inward on the weight lifting bar 7 until it contacts the clamping cable collar 50.

This invention is not to be construed as limited to the particular forms disclosed within, since these are to be regarded as illustrative rather than restrictive. It is, therefore, to be understood that the invention may be practiced within the scope of the claims otherwise than as specifically described.

The word "plumb" is used to mean directly below or in vertical alignment.

What is claimed and desired to be protected by United States Letters Patent is:

1. In a barbell support means for adjustably supporting a barbell from a fixed support above a user in position for the barbell's being raised from a starting position and lowered to a rest position by said user in exercising, the barbell support means including a fixed support and an elongate member having means for attachment to a first end of the barbell, said elongate member extending over a portion of said fixed support and having means for attachment to a second end of the barbell, the improvement comprising in combination: means for protecting a user from injury consequent to the user's raising the barbell from a starting position at a selected angle and lowering it to a rest position at an angle different from that of the starting position, consisting of: first and second stops mounted on the elongate member on opposite sides of the fixed support, said portion of the fixed support being anti-friction means for permitting the elongate member to pass freely back and forth over the fixed support anywhere between the first stop and the second stop when supporting the barbell, for return of the barbell to said starting position.

2. In means for adjustably supporting a barbell as recited in claim 1, the anti-friction means being a pulley, and means for adjusting the first and second stops along the elongate member, the first stop being in adjacent spacing to a first side of the pulley and the second stop being in adjacent spacing to a second side of the pulley.

3. In means for adjustably supporting a barbell as recited in claim 2, housing means around the pulley having a shape for permitting the elongate member to pass freely therethrough and for preventing contact between the pulley and the first and second stops.

4. A method providing for bilateral strength training of a user while lowering a barbell in exercising with an apparatus including a cable having first and second adjustable stops thereon, the cable running freely from a securance at a first end of the barbell over a supporting pulley to a securance at a second end of the barbell, comprising the steps:

(a) adjustably pre-setting each of the adjustable stops on a respective intermediate part of the cable so that the adjustable stops are symmetrically positioned with respect to the supporting pulley when the barbell is at a desired lowering angle with respect to the user;

(b) observing any departure of the adjustable stops from said position of symmetry relative to said supporting pulley while lowering the barbell; and (c) correcting any departure of the adjustable stops from said position of symmetry relative to said supporting pulley by changing the angle of the barbell while lowering the barbell, thereby promoting bilateral strength training.

* * * * *

UNITED STATES PATENT OFFICE

CERTIFICATE OF CORRECTION

Patent No. 4,709,922 Dated 12-1-87

Inventor(s) James R. Slade, Jr. and Richard F. Sterba

It is certified that error appears in the above-identified patent and that said Letters Patent are hereby corrected as shown below:

Col. 1, line 48, delete " this " and insert -- the --.

Col. 1, line 63, delete " an " and insert -- any --.

Col. 3, line 45, delete " groove " and insert -- grooved --.

Col. 3, line 46, delete " machien " and insert -- machine --.

Col. 5, line 24, delete " f " and insert -- of --.

Signed and Sealed this

Twenty-first Day of March, 1989

*Attest:*

DONALD J. QUIGG

*Attesting Officer*

*Commissioner of Patents and Trademarks*